United States Patent [19]

Okazaki et al.

[11] Patent Number: 4,943,173

[45] Date of Patent: Jul. 24, 1990

[54] SOUND DAMPENING IMPACT PRINTER

[75] Inventors: Yoji Okazaki, Yokohama; Yukami Nitta, Ohta; Shigeyoshi Harada, Akishima, all of Japan

[73] Assignee: Kabushiki Kaisha Toshiba, Kawasaki, Japan

[21] Appl. No.: 401,513

[22] Filed: Aug. 31, 1989

Related U.S. Application Data

[63] Continuation of Ser. No. 126,496, Nov. 30, 1987.

[30] Foreign Application Priority Data

Nov. 29, 1986 [JP] Japan ..... 61-285066
Oct. 12, 1987 [JP] Japan ..... 62-254786

[51] Int. Cl.[5] ..... B41J 29/10
[52] U.S. Cl. ..... 400/689; 181/201
[58] Field of Search ..... 400/689, 690; 181/201, 181/257

[56] References Cited

U.S. PATENT DOCUMENTS

| | | | |
|---|---|---|---|
| 3,513,938 | 5/1970 | Buehner et al. | 181/201 |
| 4,346,781 | 8/1982 | Ingard et al. | 181/257 |
| 4,465,390 | 8/1984 | Zander | 181/201 |
| 4,526,489 | 7/1985 | Tsumuraya et al. | 400/689 |
| 4,636,101 | 1/1987 | Matsukura et al. | 400/690 |
| 4,737,046 | 4/1988 | Inabata | 400/689 |

FOREIGN PATENT DOCUMENTS

| | | | |
|---|---|---|---|
| 270030 | 4/1988 | European Pat. Off. | 400/689 |
| 2706209 | 8/1978 | Fed. Rep. of Germany | 400/690 |
| 179677 | 10/1983 | Japan | 400/690 |
| 61-252182 | 11/1986 | Japan | 400/690 |
| 62-73980 | 4/1987 | Japan | 400/690 |

OTHER PUBLICATIONS

Gaunt et al., "Machine . . . Absorption", IBM Technical Disclosure Bulletin, vol. 25, No. 11A, p. 5490, 4–83.

*Primary Examiner*—Edgar S. Burr
*Assistant Examiner*—Joseph R. Keating
*Attorney, Agent, or Firm*—Foley & Lardner, Schwartz, Jeffery, Schwaab, Mack, Blumenthal & Evans

[57] ABSTRACT

A printer has a feeding path for guiding a printing paper from and toward an opening of the printer. A cross-sectional shape of the feeding path is minimized to be sufficient to pass the printing paper through the feeding path. At least one resonator is arranged in the feeding path. The resonator has a case defining a resonant chamber and holes formed on the case along with the feeding path. The resonant chamber communicates with the feeding path through the holes. Noises such as impact sound generated by a printing head of the printer are silenced by the resonator at frequencies around a resonance fequency of the resonator, and further silenced by the area reduced portion of the feeding path.

8 Claims, 15 Drawing Sheets

SOUND DAMPENING IMPACT PRINTER

This application is a continuation of application Ser. No. 07/126,496, filed Nov. 30, 1987 now abandoned.

BACKGROUND OF THE INVENTION

1. Field of the Invention

The present invention relates to a printer such as a wire dot-matrix impact printer, and particularly to a printer which can effectively suppress noises such as impact noises.

2. Description of the Prior Art

FIG. 1 shows an example of prior art printers of a wire dot-matrix impact type. A printer 101 comprises a printer case 103, a platen 105 and a printing head 107. The printer case 103 has an opening 109 into and from which a printing paper 111 is inserted and discharged. The printing paper 111 is transferred by the platen 105 along a path 113 and printed by the printing head 107.

The opening 109 of the printer 101 faces backward with respect to an operator to avoid noises from bothering the operator. With such an arrangement, however, if a wall is located in front of the opening 109, noises such as impact noises are reflected by the wall to bother the operator. Moreover, merely directing the opening 109 backward will not solve an overall problem of noises in an office.

According to another prior art example shown in FIG. 2, a bare noise-absorbing material 115 is arranged in a printer case 103 of a printer 101 and positioned above a path 113. In addition, the printer case 103 is bent to narrow an opening 109 to suppress noises caused by the printer 101. According to this arrangement, the spectrum of an impact noise caused by the printer 101 is of several kilohertz and has a wavelength $\lambda$ of several tens centimeters. Therefore, a thickness "t" of the noise absorbing material 115 shall satisfy an equation of $t>\lambda/4$ to realize a sufficient noise absorbing effect. Namely, the noise absorbing material 115 shall have a large thickness, and, therefore, the size of the printer case 103 becomes large to deteriorate the compactness of the printer 101.

FIG. 3 shows still another prior art example in which a bare noise-absorbing material 117 is disposed between an incoming side 111*a* and an outgoing side 111*b* of a printing paper to suppress noises generated by a printer 101. However, the noise absorbing material 117 does not have a noise screening property so that merely placing the noise absorbing material 117 in a path 113 may not help to effectively reduce the noises.

As described in the above, according to the prior art printers of the wire dot-matrix impact type, it is difficult to reduce noises to be emitted through the openings 109 of the printers 101 at the same time to realize the compactness of the printers 101.

SUMMARY OF THE INVENTION

An object of the present invention is to provide a printer which is compact and can reduce noises to be emitted from an opening of the printer through which a printing paper is fed and discharged.

Another object of the present invention is to provide a printer which can reduce noises having frequencies corresponding to those of impact noises generated by a printing head of the printer.

In order to accomplish the objects mentioned in the above, the present invention provides a printer having a feeding path along which a printing paper from an opening of the printer is transported, a cross-sectional shape of the feeding path being sufficiently small to allow the printing paper to pass therethrough. At least one resonator is disposed in the feeding path. The resonator comprises a case defining a resonant chamber therein, and holes formed on the case at positions facing the feeding path. The resonant chamber and the feeding path communicate with each other through the holes.

With such an arrangement, noises such as impact noises generated by a printing head will be silenced by the resonator disposed in the feeding path at frequencies around a resonance frequency of the resonator, and the noises are further screened by narrowed portions of the feeding path.

BRIEF DESCRIPTION OF THE DRAWINGS

These and other objects, features and advantages of the present invention will become apparent from the following description of preferred embodiments taken in conjunction with the accompanying drawings in which.

DETAILED DESCRIPTION OF THE PREFERRED EMBODIMENTS

Figure 4:
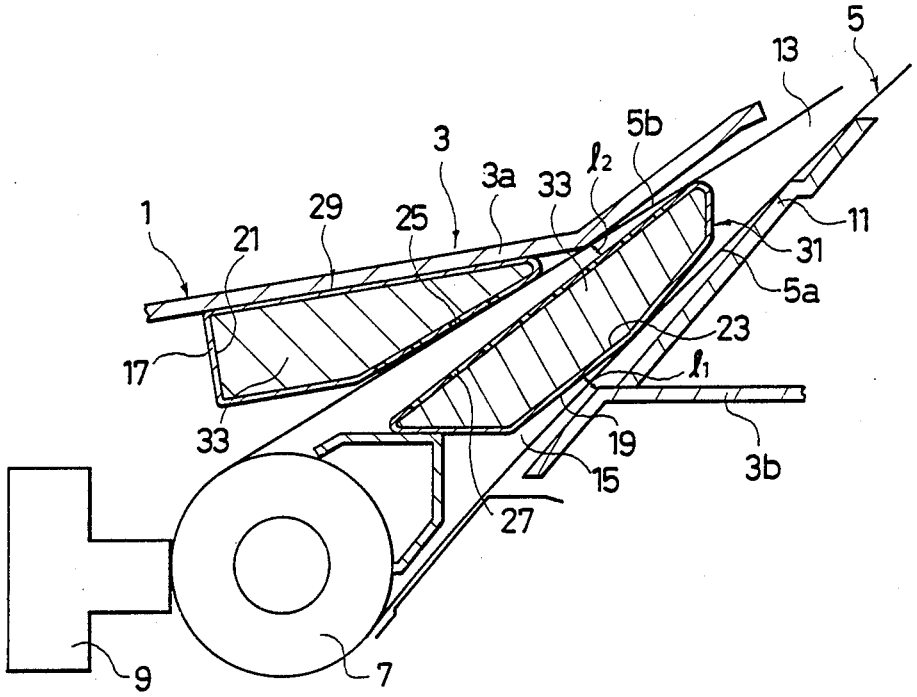
FIG. 4 is a sectional view showing an opening of a printer according to the present invention.

FIG. 4 shows the first embodiment of the present invention. A printer 1 comprises a printer case 3, a platen 7 for transferring a printing paper 5 in the printer case 3, and a printing head 9 for printing the printing paper 5.

The printer case 3 comprises an upper case 3a and a lower case 3b. The lower case 3b has a letter guide 11. Between the letter guide 11 and the upper case 3b, there is an opening 13 through which the printing paper 5 is inserted into and discharged from the printer case 3.

A feeding path 15 for feeding the printing paper 5 is formed inside the printer case 3 and between the upper case 3a and the letter guide 11. An incoming side 5a of the printing paper 5 is transferred along the letter guide 11 toward the platen 7, caught around the platen 7, and printed by the printing head 9. On the other hand, an outgoing side 5b of the printing paper 5 is transferred along the upper part of the feeding path 15 and discharged from the opening 13.

The upper case 3a is provided with a first resonant case 17 facing the feeding path 15. A second resonant case 19 is disposed in the feeding path 15 and between the incoming side 5a and the outgoing side 5b of the printing paper 5. Since the second resonant case 19 is arranged in the feeding path 15, a sectional area of the feeding path 15 is narrowed to improve a noise screening characteristic in the printer 1. The second resonant case 19 reduces the sectional area of the feeding path 15 such that the incoming side 5a and outgoing side 5b of the printing paper 5 can be transferred through the feeding path 15. Namely, a height $l_1$ and a height $l_2$ of the feeding path 15 are predetermined such that at least the printing paper 5 sufficiently pass through the feeding path 15 even with the existence of the second resonant case 19 in the feeding path 15. Therefore, the second resonant case 19 divides the opening 13 and feeding path 15 into a portion through which the incoming side 5a of the printing paper 5 is passed and a portion through which the outgoing side 5b of the printing paper 5 is passed. As a result, the printing paper 5 can smoothly inserted into and discharged from the printer 1.

The first and second resonant cases 17 and 19 have flat box-like configurations respectively, to define first and second resonant chambers 21 and 23 having volumes V1 and V2, respectively. The first resonant case 17 faces the second resonant case 19 to pass the outgoing side 5b of the printing paper 5 between them. All over the opposing faces of the first and second resonant cases 17 and 19, there are formed holes 25 and 27 each having predetermined dimensions. Namely, the holes 25 and 27 are formed along the feeding path 15 such that the feeding path 15 communicates with the first resonant chamber 21 through the holes 25, while communicating with the second resonant chamber 23 through the holes 27. The first and second resonant chambers 21 and 23 defined by the first and second resonant cases 17 and 19 respectively, and the holes 25 and 27 constitute first and second Helmholtz resonators 29 and 31, respectively.

Noise absorbing materials 33 such as glass wool are disposed inside the first and second resonant cases 17 and 19, respectively.

Figure 5:
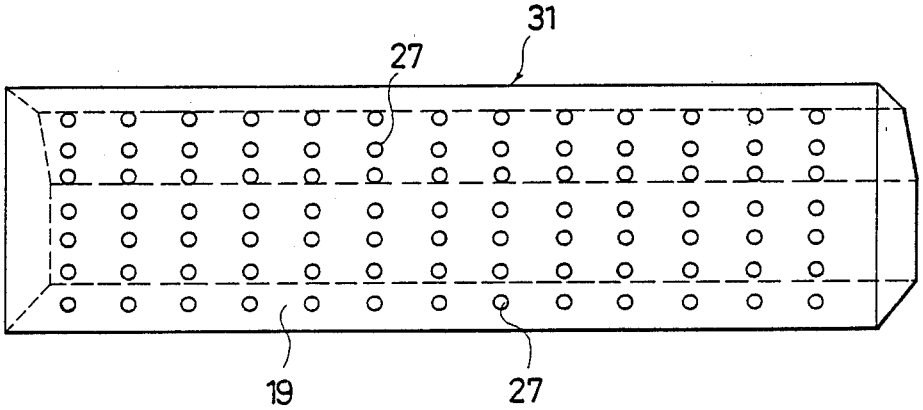
FIG. 5 is a front view showing a second resonator shown in FIG. 4.

FIG. 5 is a front view showing the second resonator 31. A plurality of the holes 27 are formed on the second resonant case 19 regularly in the feeding direction of the printing paper 5 (from the top to the bottom of the figure) as well as in the width direction of the printing paper 5 (from the left to the right of the figure).

Figure 6:
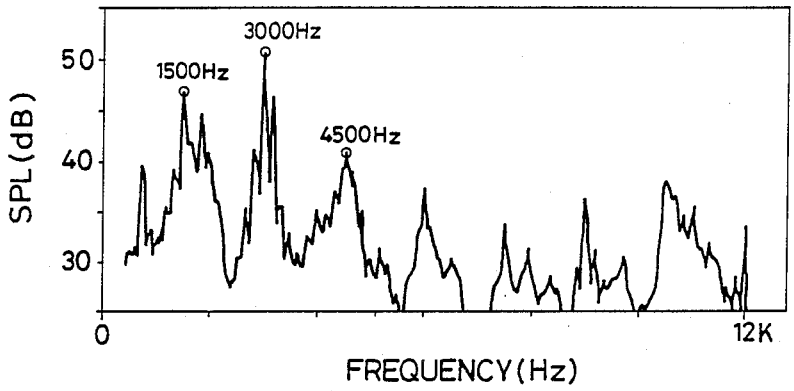
FIG. 6 is a graph showing the noise spectra of a printer.

FIG. 6 shows the spectra of noises generated by the printer 1 shown in FIG. 4. The noises are constituted by high frequencies on the basis of a frequency of 1500 Hz (an exciting frequency of the printing head 9) which is the frequency of an impact noise caused when pins (not shown) of the printing head 9 are driven. As shown in the figure, the spectrum of a frequency of 3000 Hz is particularly large.

Generally, a resonance frequency $f_0$ of a Helmholtz resonator is expressed as follows:

$$f_0 = C/2\pi \times \sqrt{G/V}$$

where;

C: sound velocity

G: conductivity of neck portion (hole 25 or 27)

V: volume of resonant chamber 21 or 23

Figure 7:
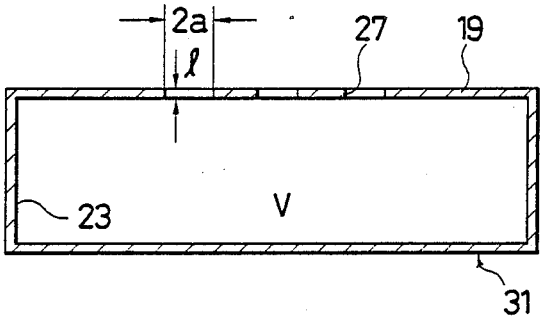
FIG. 7 is a model showing the constitution of the resonator shown in FIG. 4.

The conductivity G can be obtained from the following equation, subject that there are "n" pieces of the holes 27 each having a circular shape formed on a model of the second resonant case 19 an shown in FIG. 7:

$$G=(n\pi a^2)/(l+\pi a/2)$$

where;

a: radius of hole 27 l: depth of hole 27, i.e., thickness of second resonant case 19

According to this embodiment, the Helmholtz resonance frequency $f_0$ of each of the first and second resonators 29 and 31 is set to 3000 Hz which is one of the integer multiples of an exciting frequency (1500 Hz) of the printing head 9 and at which the maximum sound power appears.

The operation of this embodiment will be described.

Figure 8:
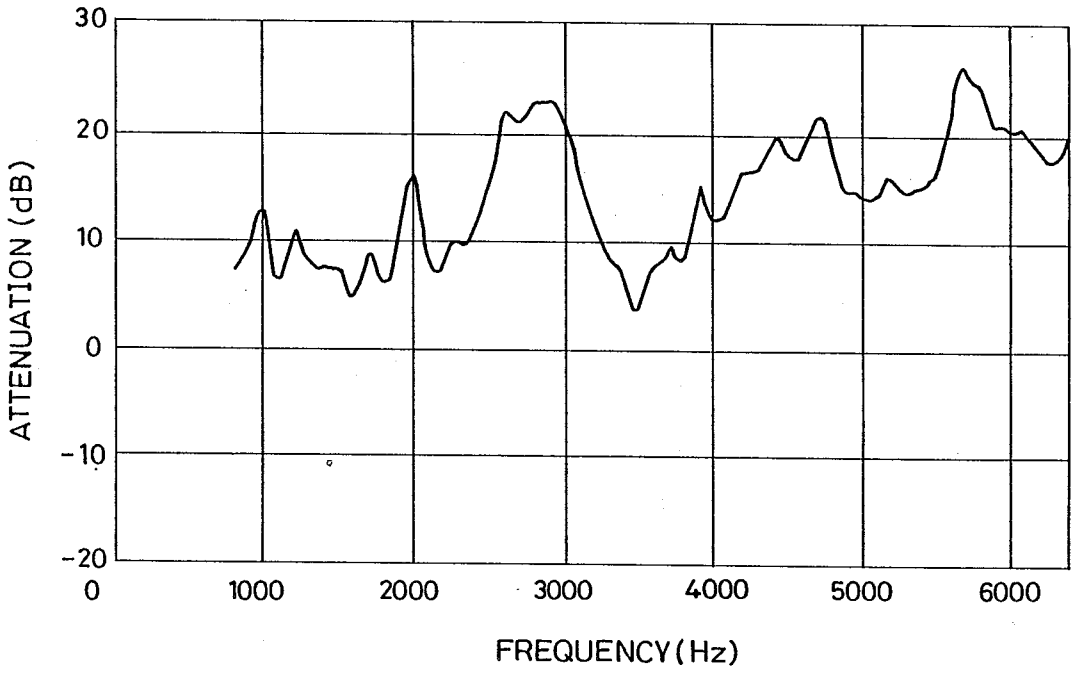
FIG. 8 is a graph showing attenuation in sound power levels of the printer according to the present invention, measured with a random sound source.

FIG. 8 is a view showing sound power exhausted from the opening 13 when a random sound source is positioned in the printer case 3. In FIG. 8, attenuation in the sound power levels of the printer 1 of the present invention is indicated with respect to the sound power levels of the prior art printer 101 shown in FIG. 1 which are set to 0 dB respectively. As shown in the figure, the attenuation is remarkable around a frequency of 3000 Hz which is the resonance frequency of the first and second resonators 29 and 31.

Figure 1:
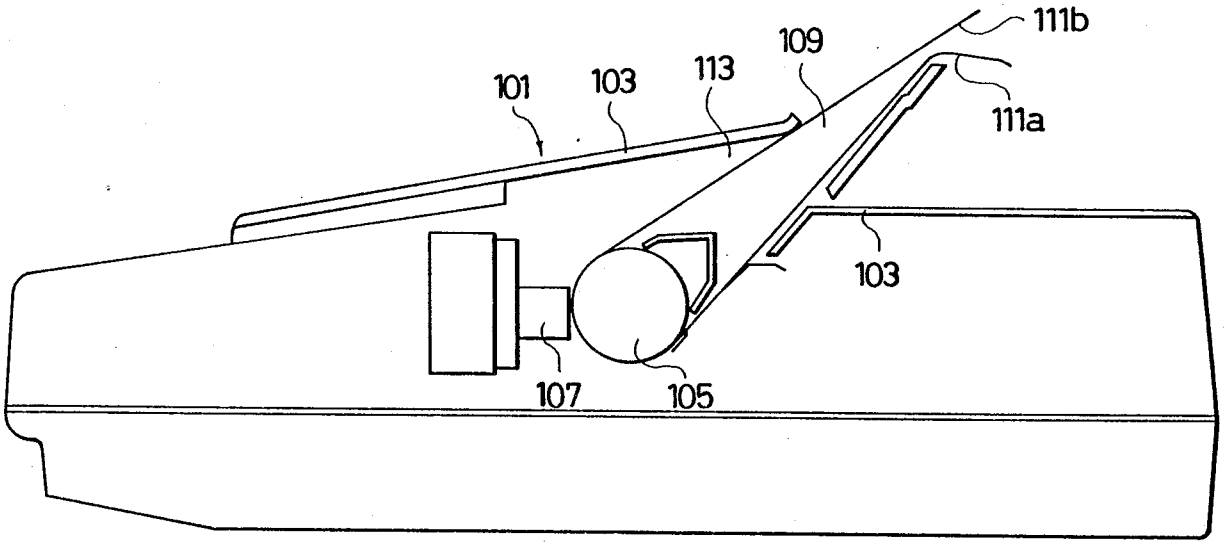
FIG. 1 PRIOR ART
FIG. 1 is a side view partly sectioned, showing a printer according to a prior art.
Figure 2:
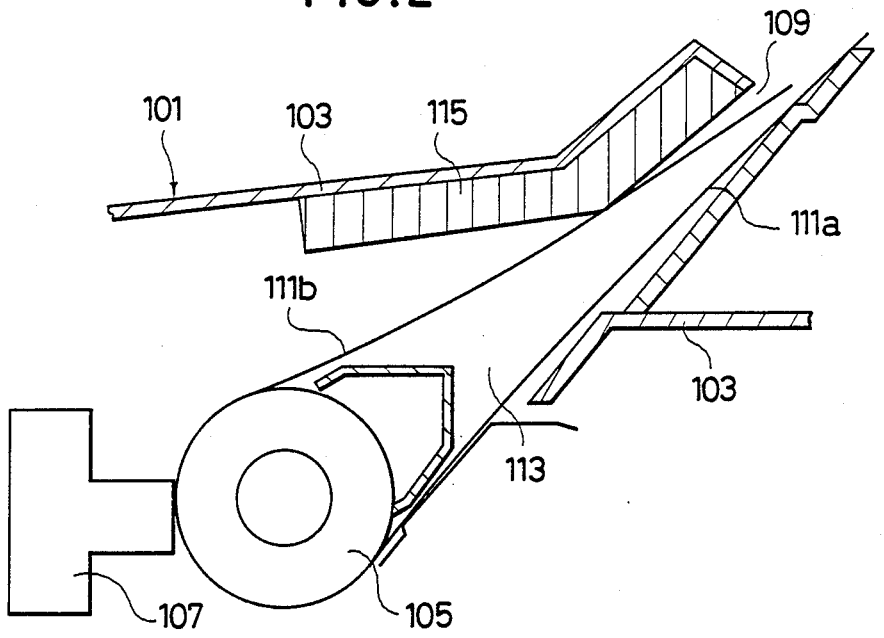
FIGS. 2 and 3 are sectional view showing openings of prior art printers, respectively.
Figure 3:
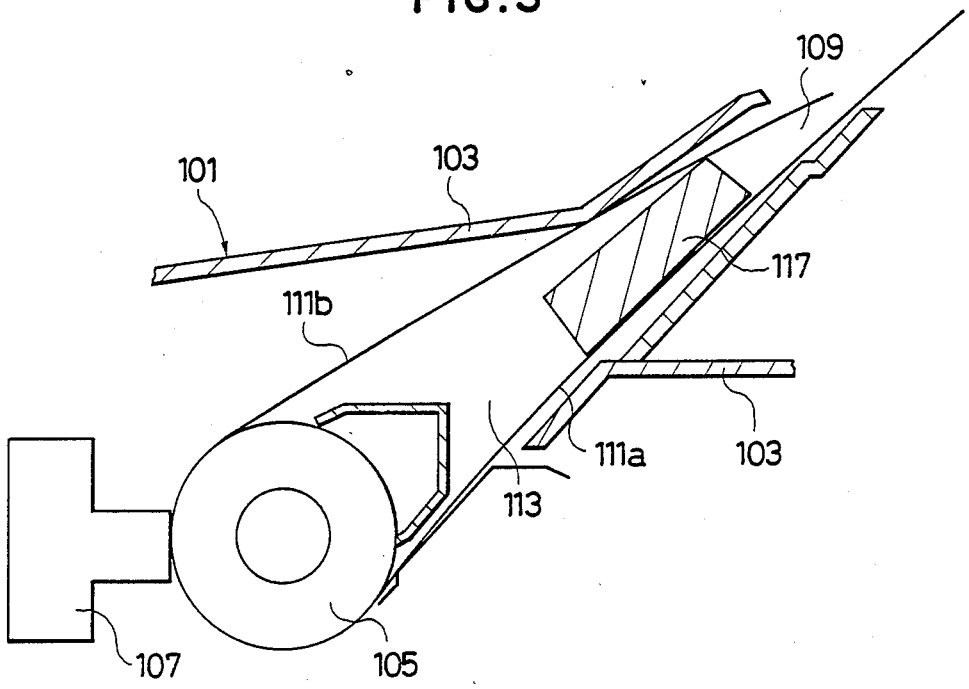
Figure 9:
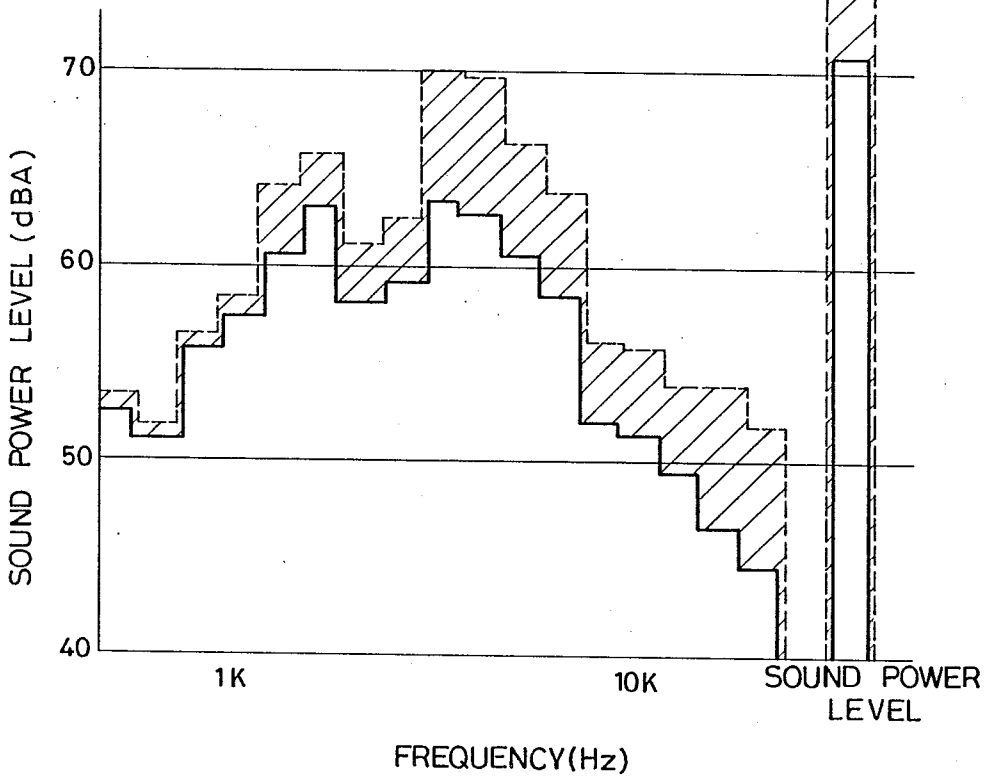
FIG. 9 is a graph showing differences in sound power levels between the prior art printer and the printer of the present invention.

FIG. 9 is a view showing the sound power levels of noises generated during an actual printing operation. In the figure, the sound power levels of the printer 101 shown in FIG. 1 are indicated by a dashed line, while the sound power levels of the printer 1 shown in FIG. 4 are indicated by a continuous line. Compared to the prior art, the printer 1 of the present invention can reduce the sound power levels by about 5 dB respectively.

As mentioned in the above, according to this embodiment, a cross sectional shape of the feeding path 15 is reduced sufficiently to pass the printing paper 5 through the feeding path 15 in which the first and second resonators 29 and 31 are disposed. Each of the resonators 29 and 31 has a resonance frequency of 3000 Hz which is one of the integer multiples of the exciting frequency (1500 Hz) of the printing head 9 and at which the maximum sound power appears. Inside the first and second resonators 29 and 31, there are provided the noise absorbing materials 33 respectively. As a result, noises generated in the printer 1 are effectively silenced around the resonance frequency due to the resonance effects of the first and second resonators 29 and 31, and a screening effect of the noises is further improved because the cross-sectional shape of the feeding path 15 is reduced.

Since the noise absorbing materials 33 are arranged inside the first and second resonant cases 17 and 19, the noise absorbing materials 33 will not drop, due to the deterioration thereof, onto the printing paper 5 and will not be transported toward the platen 7 to cause a trouble.

In this embodiment, for instance the first resonator 29 may be omitted. However, if it is arranged, it can improve the noise reducing effect. Furthermore, in this embodiment, without an arrangement of the noise absorbing materials 33, the noise is reduced sufficiently by the resonant operation of the resonators.

Other embodiments will now be explained with like numerals shown in the first embodiment representing like parts.

Figure 10:
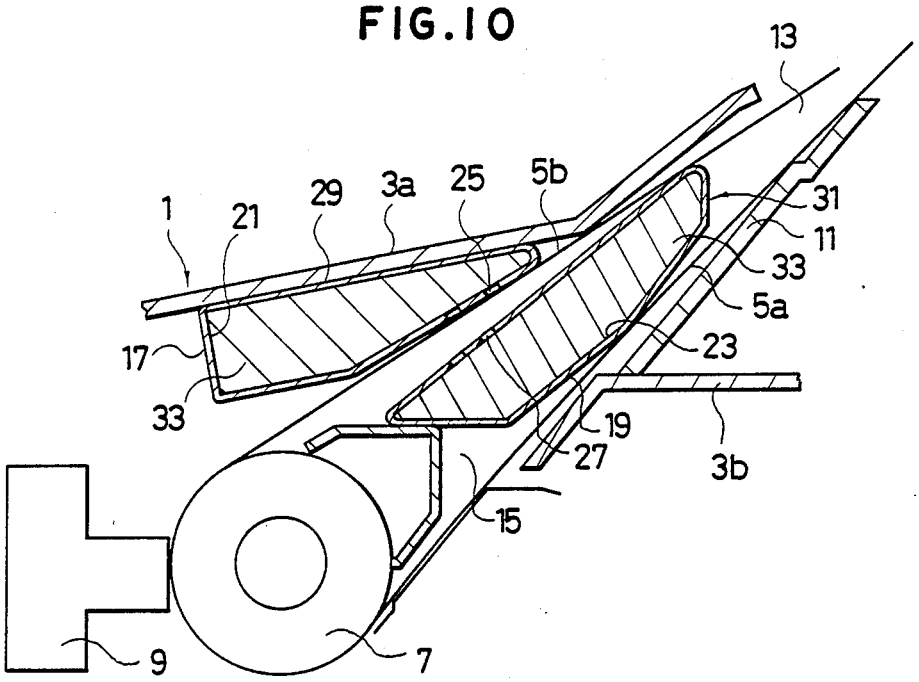
FIG. 10 is a sectional view showing a printer according to a second embodiment of the present invention.

FIG. 10 is a view showing the second embodiment of the present invention. According to this embodiment, holes 25 and 27 are formed only partly on the opposing faces of first and second resonant cases 17 and 19. If the holes 25 and 27 are formed at least along the width of an incoming side 5*a* and an outgoing side 5*b* of a printing paper 5, the same effect as that of the first embodiment will be realized. Further, interference between the holes 25 and 27 may be suppressed with this arrangement.

Figure 11:
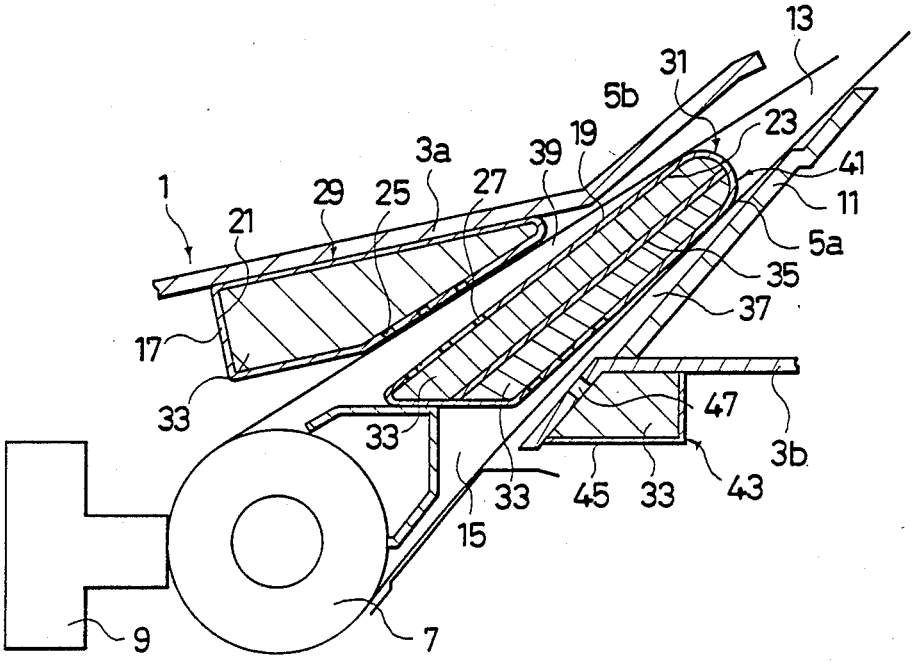
FIG. 11 is a sectional view showing a printer according to a third embodiment of the present invention.

FIG. 11 is a view showing the third embodiment of the present invention. According to this embodiment, a partition member 35 is disposed in a feeding path 15 to divide the feeding path 15 into an incoming path 37 and an outgoing path 39. Namely, an incoming side 5*a* of a printing paper 5 passes through the incoming path 37, while an outgoing side 5*b* of the printing paper 5 passes through the outgoing path 39. First and second resonators 29 and 31 same as those adopted in the second embodiment are disposed to pass the outgoing side 5*b* of the printing paper 5 between them. In addition, a third resonator 41 and a fourth resonator 43 are disposed to pass the incoming side 5*a* of the printing paper 5 between them. The third resonator 41 and the second resonator 31 are disposed to narrow a cross-sectional shape of the feeding path 15 such that the printing paper 5 can be passed through the feeding path 15. The fourth resonator 43 comprises a resonant case 45 fixed to a lower case 3*b* and holes 47 formed on the lower case 3*b*.

A printer 1 of the wire dot-matrix impact type generates many noises from a printing head 9, and the noises tend to be exhausted through the outgoing path 39 which has no sound obstacles such as a platen 7. However, by providing the third and fourth resonators 41 and 43 in the incoming path 37, a noise reducing effect of the printer 1 can be improved. According to this embodiment, at least the second resonator 31 in the outgoing path 39 and the third resonator 41 in the incoming path 37 are required to be disposed, and, for instance, the first and fourth resonators 29 and 43 may be omitted to achieve the same effect.

Figure 12:
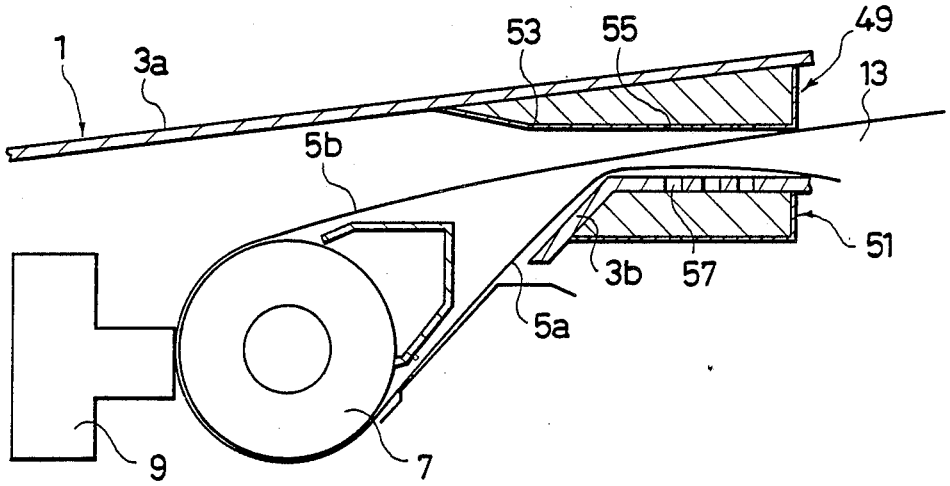
FIG. 12 is a sectional view showing a printer according to a fourth embodiment of the present invention.

FIG. 12 shows the fourth embodiment of the present invention. According to this embodiment, a fifth resonator 49 is arranged under an upper case 3*a* of a printer 1 to reduce the cross-sectional shape of a feeding path 15. A sixth resonator 51 is arranged under a lower case 3*b* of the printer 1. The fifth resonator 49 comprises a resonant case 53 having holes 55. For the sixth resonator 51, holes 57 are formed on the lower case 3*b* of the printer 1. Since the feeding path 15 is not divided into the incoming path 37 and the outgoing path 39 for incoming and outgoing sides 5*a* and 5*b* of a printing paper 5 as in the case of the third embodiment, the fourth embodiment is particularly suitable for a printer which uses a continuous paper.

Figure 13:
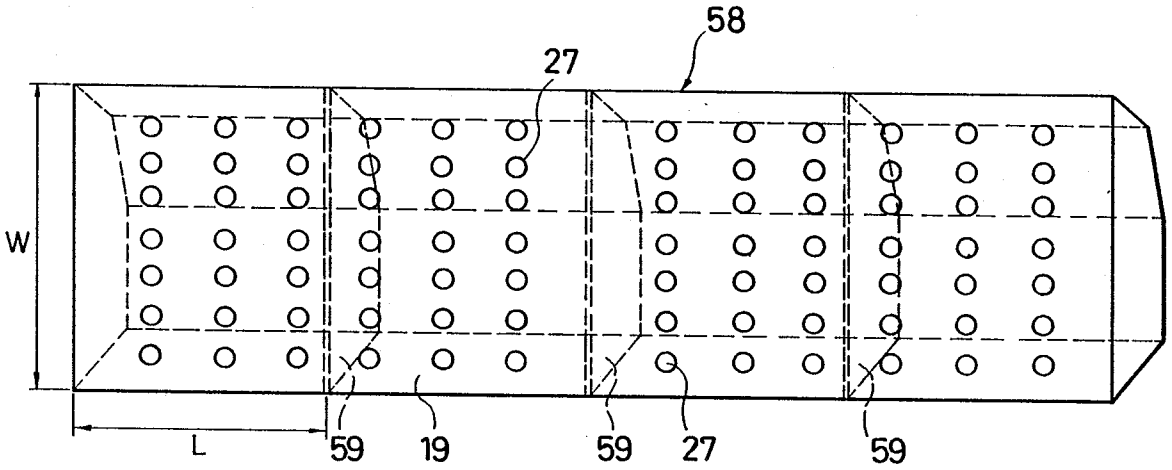
FIG. 13 is a front view showing a resonator according to a fifth embodiment of the present invention.

FIG. 13 shows a second resonator 58 of the fifth embodiment of the present invention. The second resonator 58 of this embodiment is made by providing a plurality of partitions 59 for the resonant case 19 of the second resonator 31 of the first embodiment. The inside of the resonant case 19 of the second resonator 58 is divided in four equal parts by the partitions 59 in a width direction of the printing paper 5*b*. Each plane having the holes 27 in each equal parts has a width W and a length L, as shown in FIG. 13. In this embodiment, the width W and length L are predetermined less than one-third of the wavelength $\lambda$ of the resonance frequency $f_0$. With the predetermined width W and length L, a remarkably improved noise reducing effect is appeared by an experimental results. Particularly, noise of a high frequency higher than 1000 Hz which should be reduced in the printer can be effectively reduced. Furthermore, the partitions 59 give good rigidity to the case 19.

FIGS. 14 to 18 show the sixth embodiment of the present invention.

In the sixth embodiment, components other than resonators are the same as those of the first embodiment shown in FIG. 4, and, therefore, like components will be represented by like numerals to omit the explanation of the common components.

Figure 14:
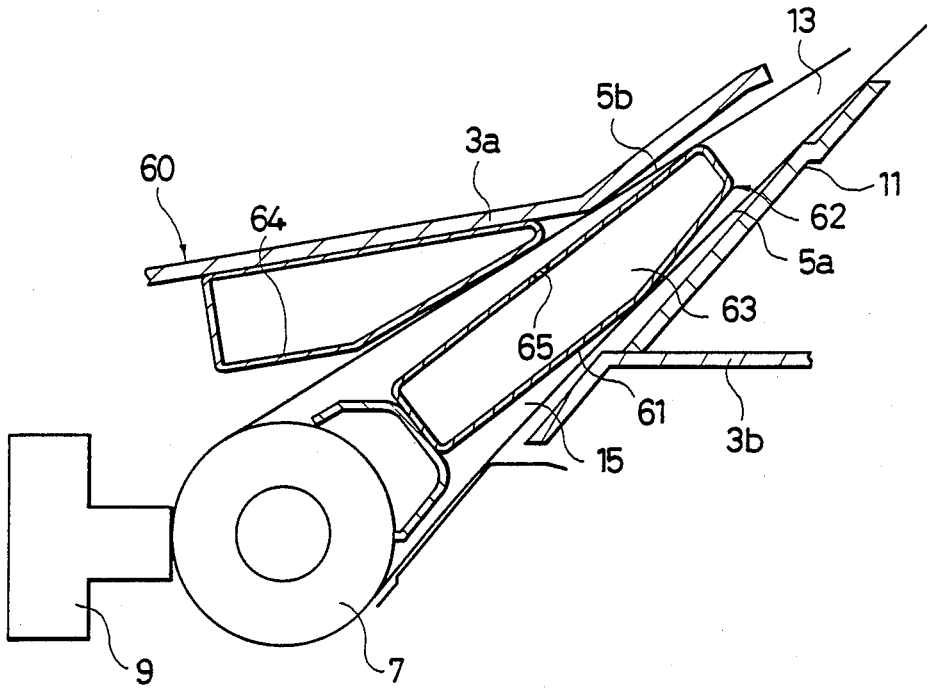
FIG. 14 is a sectional view showing a printer according to a sixth embodiment of the present invention.

A printer 60 of the sixth embodiment comprises a first resonator 62 having a first flat resonant case 61 as shown in FIG. 14. The first resonant case 61 defines inside thereof a first resonant chamber 63 having predetermined dimensions. A hollow box 64 facing a feeding path 15 is provided for an upper case 3*a*. The box 64 faces the first resonant case 61 to pass an incoming side 5*a* of a printing paper 5 between them.

The first resonant case 61 has holes 65 formed at predetermined positions on a face thereof opposing the box 64. Namely, the holes 65 are located along the feeding path 15 to connect the feeding path 15 with the first resonant chamber 63.

A space in front of the holes 65 is reduced by the box 64.

The first resonant chamber 63 defined by the first resonant case 61 and the holes 65 constitute a first resonant 62 of a side branch type.

Figure 15:
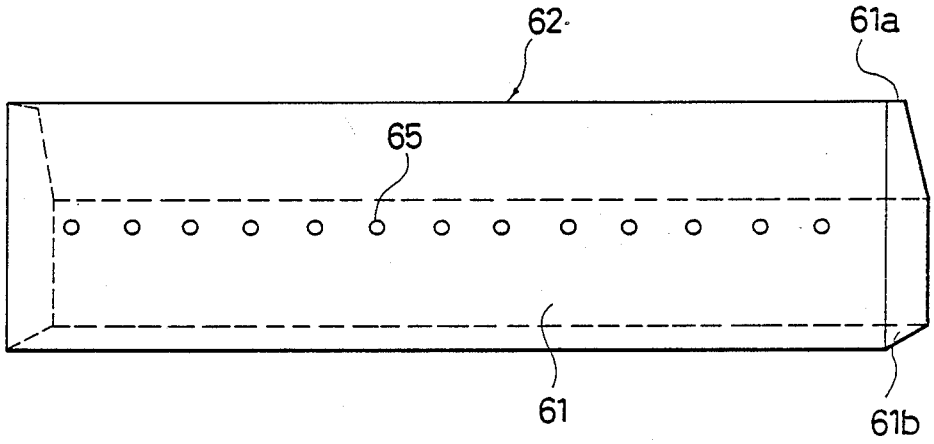
FIG. 15 is a front view showing a resonator shown in FIG. 14.

FIG. 15 shows a front of the first resonator 62. The holes 65 of the first resonant case 61 are regularly arranged in the width direction (from the left to the right of the figure) of the printing paper 5.

Figure 16:
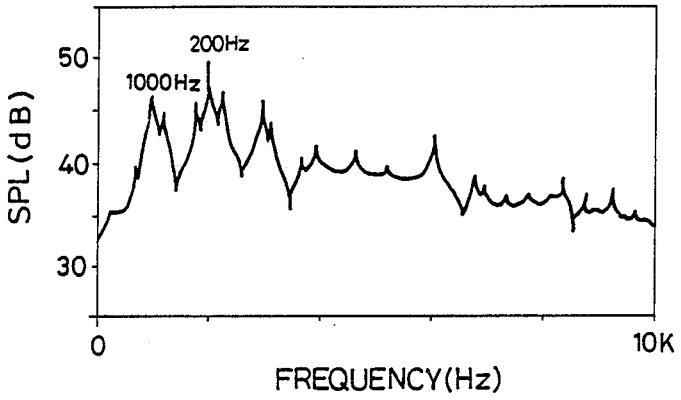
FIG. 16 is a graph showing the noise spectra of the printer according to the present invention.

Noises generated by the printer 60 shown in FIG. 14 constitute spectrum shown in FIG. 16. As shown in the figure, the noises of the printer 60 are formed by higher harmonics on the basis of an impact frequency of 1000 Hz (an exciting frequency of a printing head 9 of the printer 60) generated when pins (not shown) of the printing head 9 are driven. The spectrum of a frequency of 2000 Hz is particularly large in the figure.

Figure 17:
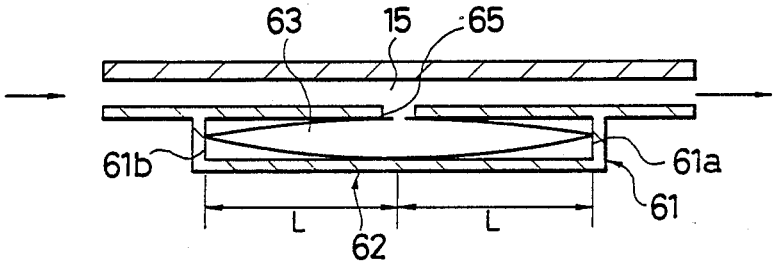
FIG. 17 is a model showing the constitution of the resonator shown in FIG. 14.

In FIG. 17 which shows a model of the first resonator 62 of the side branch type, a resonance frequency $f_n$ is expressed as follows:

$$f_n = (2n-1)d/4L \ (n=1,2,3,\ldots)$$

where;

C: sound velocity

L: a distance between the hole 65 and an inner wall 61*a* of the first resonant case 61, the inner wall 61*a* being located at each end of the first resonant chamber 63 in the feeding direction of the printing paper 5

As apparent from the equation, a primary resonance is generated when one fourth of a wavelength λ of a noise coincide with the distance between the hole 65 and the inner wall 61*a* of the first resonant case 61. Although the distance from the hole 65 to the inner wall 61*a* is set to be equal to a distance from the hole 65 to an inner wall 61*b* in FIG. 17, it will be acceptable if one "L" of the distances satisfies the equation of the resonance frequency.

In the sixth embodiment, a resonance frequency $f_1$ of the first resonator 62 is set to 2000 Hz which is one of the integer multiples of an exciting frequency (1000 Hz) of the printing head 9 and at which the maximum sound power appears.

The operation of the sixth embodiment will be described.

Figure 18:
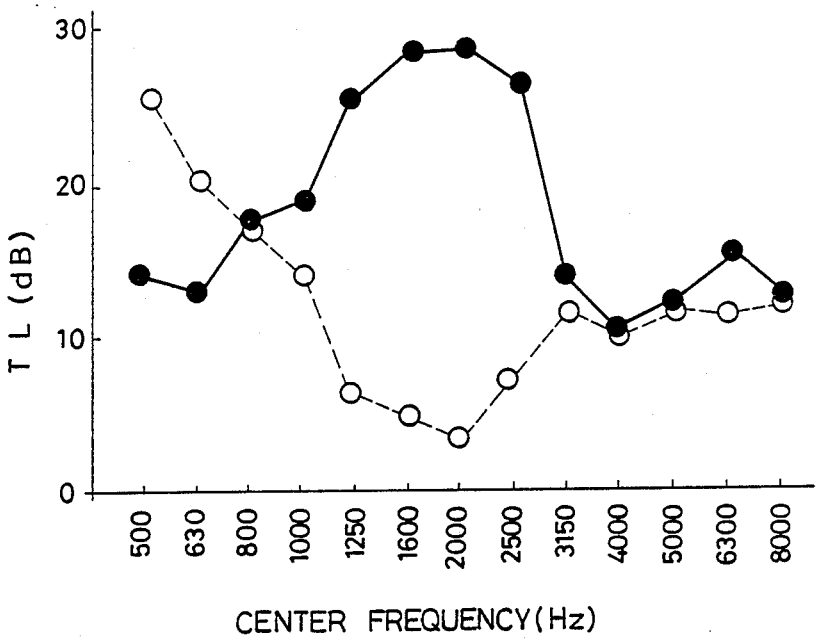
FIG. 18 is a view showing transmission losses at an opening of a reverberation box, measured with a random sound source positioned in the reverberation box.

For instance, a reverberation box is made in place of the printer case 3, and a random sound source is placed inside the reverberation box to measure sound transmission losses at an opening 13. Results of the measurement are shown in FIG. 18. In the figure, a continuous line represents a reverberation box having a flat gap corresponding to the feeding path 15 in which a resonator of the side branch type is disposed, while a dashed line represents a reverberation box having only the gap with no resonator in the feeding path. The box with the resonator shows a high transmission loss at a frequency of 2000 Hz having a wavelength four times the length "L" shown in FIG. 17, compared to the box with only the gap.

As described in the above, according to the sixth embodiment, a cross-sectional shape of the feeding path 15 is reduced to sufficiently pass the incoming and outgoing sides 5*a* and 5*b* of the printing paper 5 through the feeding path 15, and, in the feeding path 15, there is arranged the first resonator 62 having a resonance frequency of 2000 Hz which is one of the integer multiples of the exciting frequency (1000 Hz) of the printing head 9 and at which the maximum sound power appears. Therefore, noises generated in the printer 60 are effectively silenced at around the resonance frequency due to a resonance effect of the first resonator 62. In addition, the noises are further screened due to the reduction in the cross-sectional shape of the feeding path 15.

Since a space in front of the holes 65 is reduced by the box 64, the silencing effect of the first resonator 62 will be improved in the same manner as that of a resonant type silencer, compared to a printer case without the box 64. Particularly, noises having frequencies of 1000 Hz and higher which are preferable to be eliminated, can effectively be silenced.

Even if the box 64 is of a solid type, the same effect will be achieved.

Other embodiments relating to the sixth embodiment will be described below with like parts represented by like numerals.

Figure 19:
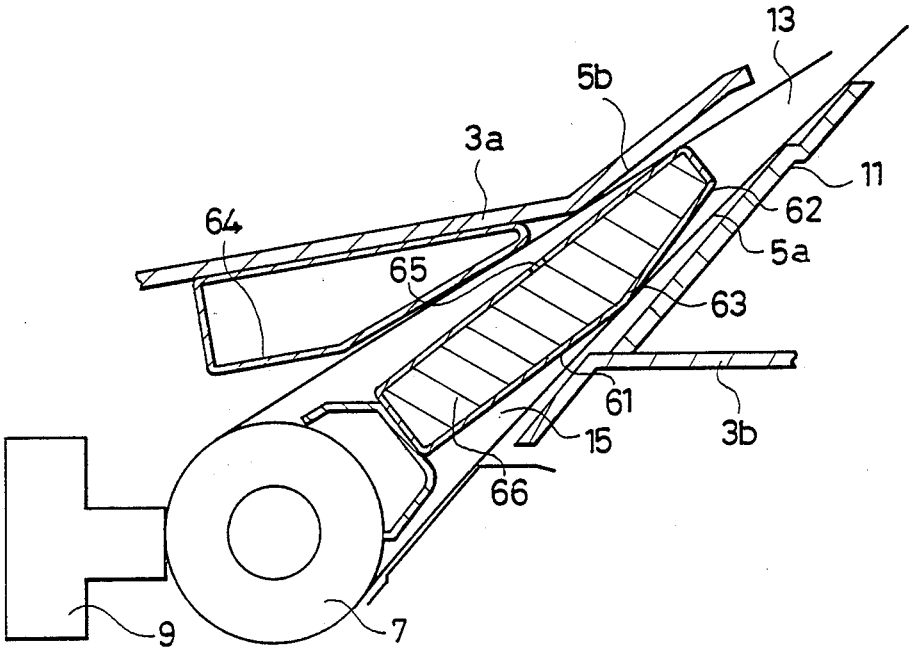
FIG. 19 is a sectional view showing a printer according to a seventh embodiment of the present invention.

FIG. 19 is a view showing the seventh embodiment of the present invention. According to this embodiment, a noise absorbing material 66 made of glass wool, etc., is disposed inside a first resonant case 61. With this arrangement, noises are effectively silenced by the noise absorbing material 66 in combination with the resonance effect of a first resonator 62 constituted by the first resonant case 61.

Figure 20:
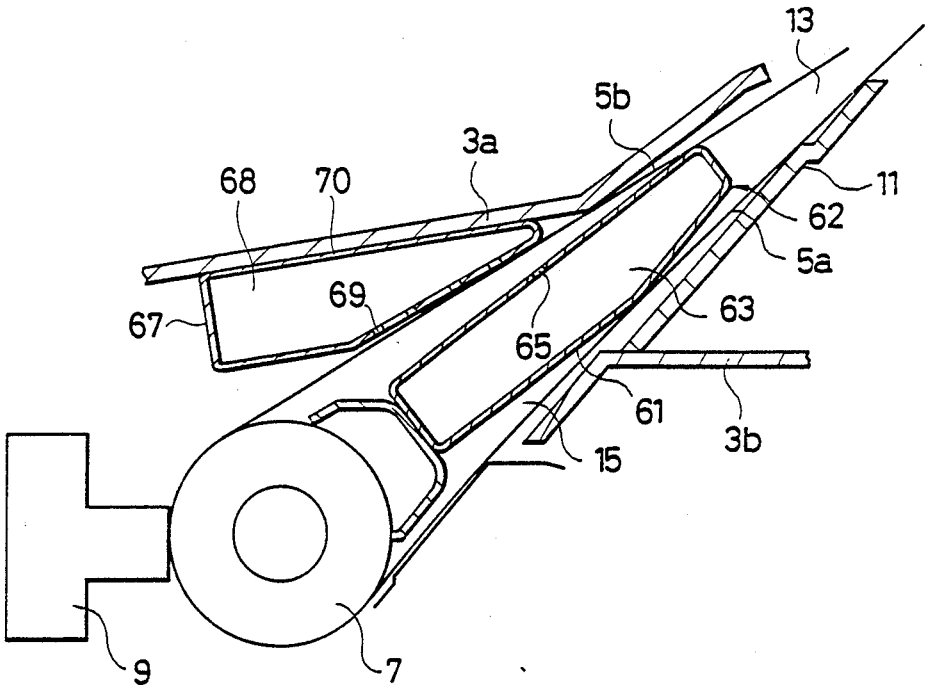
FIG. 20 is a sectional view showing a printer according to an eighth embodiment of the present invention.
Figure 21:
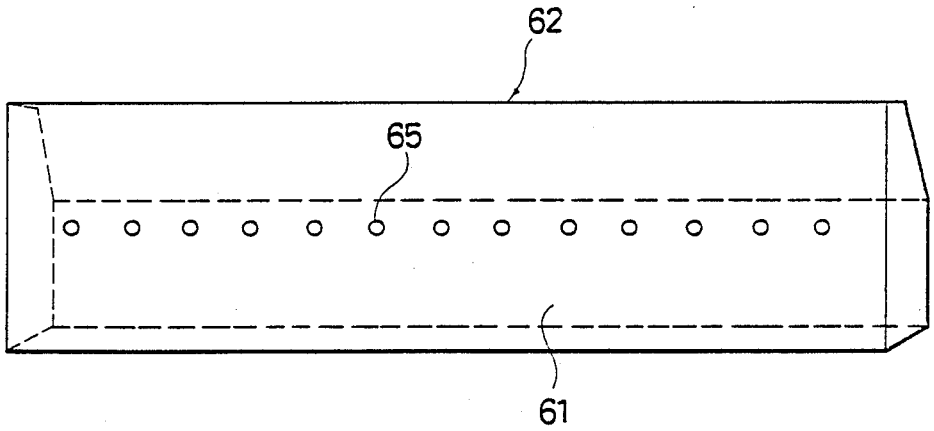
FIG. 21 is a front view showing a resonator shown in FIG. 20.

FIGS. 20 and 21 show the eighth embodiment of the present invention. According to this embodiment, a second resonant case 67 in place of the box 64 is arranged under an upper case 3*a* to face a feeding path 15. Inside the second resonant case 67, there is defined a second resonant chamber 68, and there are formed holes 69 allover one surface of the second resonant case 67 opposing a first resonant case 61.

As a result, the second resonant chamber 68 defined by the second resonant case 67 and the holes 69 constitute a second resonant 70. A space in front of the holes 69 and 65 of the first and second resonators 62 and 70 is reduced by them.

According to the above-mentioned arrangement, the first and second resonators 62 and 70 reduce noises more effectively than the sixth embodiment.

Figure 22:
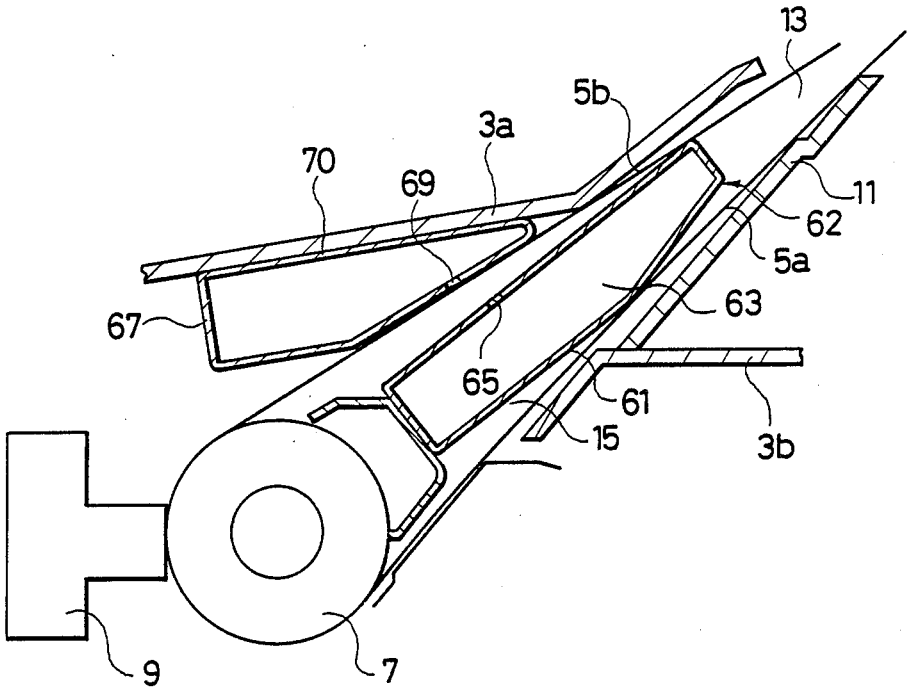
FIG. 22 is a sectional view showing a printer according to a ninth embodiment of the present invention.
Figure 23:
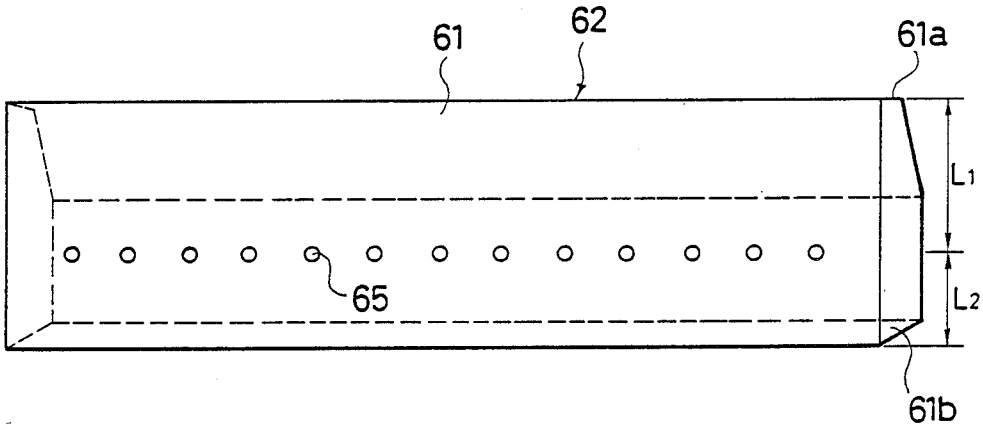
FIG. 23 is a front view showing a resonator shown in FIG. 22.

FIGS. 22 and 23 show the ninth embodiment of the present invention. In this embodiment, a distance $L_1$ between a hole 65 and an inner wall 61*a* of resonant case 61 differs from a distance $L_2$ between the hole 65 and an inner wall 61*b* of the resonant case 61. As a result, the resonance frequencies of a second resonator 62 can be set to two frequencies at which large sound power appears, thereby reducing noise levels at both the frequencies. As shown in FIG. 23 which is a front view of the first resonator 62, a plurality of the holes 65 are regularly arranged on the resonant case 61 at positions distanced by $L_1$ from the inner wall 61*a* and by $L_2$ from the inner wall 61*b* of the resonant case 61.

Figure 24:
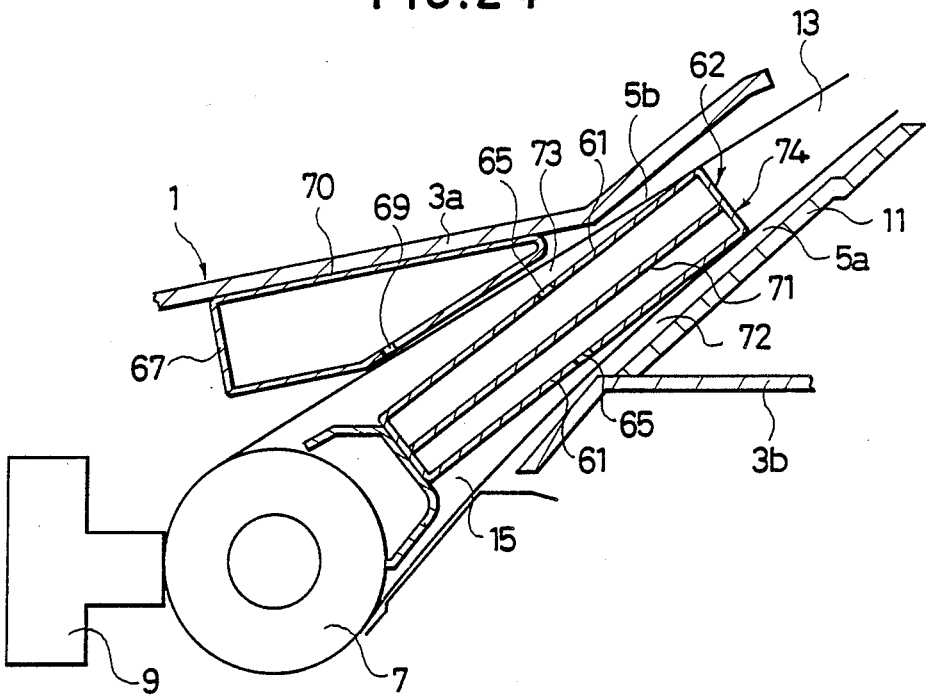
FIG. 24 is a sectional view showing a printer according to a tenth embodiment of the present invention.

FIG. 24 shows the tenth embodiment of the present invention. In this embodiment, a partition member 71 is disposed in a feeding path 15 to divide the feeding path 15 into an incoming path 72 and an outgoing path 73. Namely, an incoming side 5*a* of a printing paper 5 passes through the incoming path 72, while an outgoing side of the printing paper 5*b* passes through the outgoing path 73. There are disposed first and second resonators 62 and 70 shown in the eighth embodiment to pass the outgoing side 5*b* of the printing paper 5. In addition, a third resonator 74 is disposed to pass the incoming side 5*a* of the printing paper 5 thereunder. The third resonator 74 as well as the first resonator 62 reduce a cross-sectional shape of the feeding path 15 to sufficiently pass the incoming and outgoing sides 5*a* and 5*b* of the printing paper 5 through the feeding path 15.

A printer 1 of the wire dot-matrix impact type generates noises from a printing head 9, and the noises tend to be exhausted through the outgoing path 73 having no obstacles such as a platen 7 for preventing the noises from exiting outside. However, by providing the third resonator 74 in the incoming path 72, the noises can effectively be reduced. According to the tenth embodiment, it is sufficient to arrange the third resonator 74 in the incoming path 72, and the first resonator 62 in the outgoing path 73, and, for instance, the second resonator 70 may be omitted to achieve the same noise reducing effect.

Figure 25:
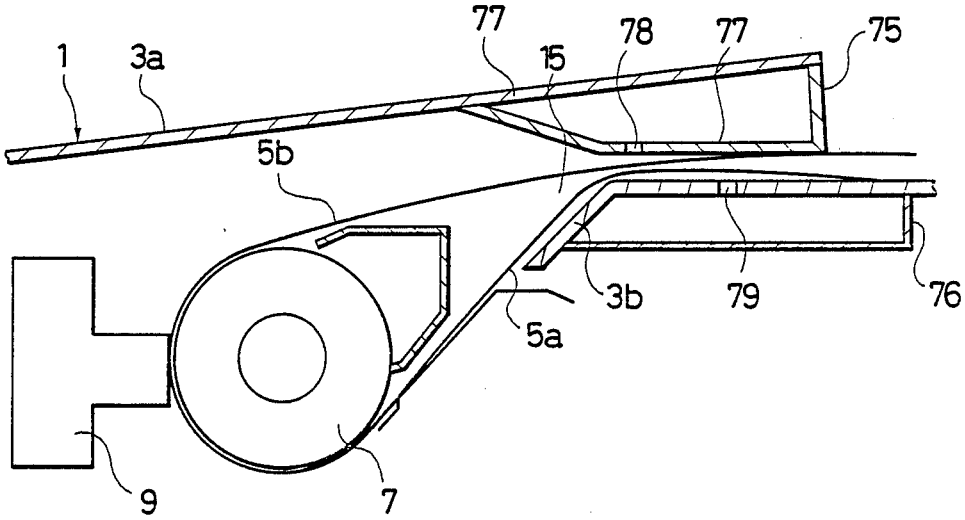
FIG. 25 is a sectional view showing an eleventh embodiment of the present invention.

FIG. 25 shows the eleventh embodiment. In this embodiment, a fourth resonator 75 is arranged under an upper case 3*a* to narrow the cross-sectional area of a feeding path 15 of a printer 1. In addition, a fifth resonator 76 is arranged under a lower case 3*b*. The fourth resonator 75 comprises a resonant case 77 having holes 78, while the fifth resonator 76 have holes 79 formed on the lower case 3*b*.

In this embodiment, the feeding path 15 is not divided into the incoming path 72 and the outgoing path 73 for passing the incoming and outgoing sides of a printing paper 5 as in the eighth embodiment, so that the printer 1 is particularly suitable for a continuous paper.

The present invention is not limited by the above-mentioned embodiments but various modifications thereof are possible. For instance, a shape of the hole may be not only circular but also elliptic or rectangular, and the noise absorbing material or the letter guide (for a printer of an automatic sheet feeder type) may not be required to achieve the same noise absorbing effect.

Further, a cross-sectional shape of the feeding path 15 may be reduced by deforming the upper case 3*a* or the lower case 9*b* to achieve the same noise reducing effect.

For instance, in the first embodiment, a resonance frequency of the first resonator 29 can be set to 3000 Hz, and a resonance frequency of the second resonator 31 to 1500 Hz at which the second largest sound power appears, thereby reducing noise levels at both the frequencies.

In summary, according to the present invention, the cross-sectional shape of a feeding path of a printer is reduced, and a resonator is provided in the feeding path so that noises to be exhausted from an opening of the printer can effectively be reduced without increasing the size of the printer, thereby providing an effective countermeasure against the noises.

What is claimed is:

1. A printer having a printing head for printing on paper supplied through an opening to the printing head in which noise is emitted from the printing head to the opening, comprising:

a feed path for guiding the paper from the opening toward the printing head and subsequently guiding the printing paper from the printing head toward the opening; and at least one Helmholtz resonator disposed in said feeding path for reducing the cross-sectional area of said feeding path to a minimum area through which the printing paper passes, said helmholtz resonator having a resonant chamber with at least one hole therein, through which the resonant chamber communicates with said feed path so as to attenuate the noise power level at the exciting frequency of the printing head, and at least one said hole being concentrated, at one point in the noise emitting direction;

wherein the resonant chamber is divided in a plurality of parts such that each divided part has a volume V and at least one of the holes has radius a and depth l, such as satisfy the following equations:

$$f=C/2\pi 2\pi x\ G/V$$

$$G=(n\pi a^2)/(l+\pi a/2)$$

f: one of integer multiples of the exciting frequency of the printing head at which maximum sound power appears;

C: sound velocity;

G: conductivity of the hole of the resonant chamber.

2. The printer as claimed in claim 1, wherein said feeding path is divided by said resonator into an incoming path and an outgoing path along which said printing paper is transported.

3. The printer as claimed in claim 1, wherein a noise absorbing material is disposed inside the case of said resonator.

4. The printer as claimed in claim 1, wherein the resonant chamber of the case is divided in a plurality of parts, such that the width and length of each divided part are less than $\frac{1}{3}$ of a wavelength of a resonance frequency of said resonator.

5. A printer having a printing head for printing on paper supplied through an opening to the printing head, comprising:

a feeding path for guiding the paper from the opening toward the printing head and subsequently guiding the printing paper from the printing head toward the opening; and at least one side branch resonator disposed in said feeding path for reducing the cross-sectional area of said feeding path to a minimum area through which the printing paper passes, said resonator having a resonant chamber, with at least one hole therein, through which the resonant chamber communicates with said feed path so as to attenuate the sound power level at the exciting frequency of the printing head, the hole being positioned such that each distance from the hole to one of inner walls located at one end of the resonant chamber in a paper feeding direction is one fourth of a wavelength of a frequency which is one of the integer multiples of an exciting frequency of the printing head and at which the maximum sound power appears.

6. The printer as claimed in claim 5, wherein the sizes and shapes of the resonant chamber and holes are predetermined such that said resonator has a frequency which is one of the integer multiples of the exciting frequency of the printing head and at which maximum sound power appears.

7. The printer as claimed in claim 5, wherein said feeding path is divided by said resonator into an incoming path and an outgoing path along which the printing paper is transported.

8. The printer as claimed in claim 5, wherein a noise absorbing material is disposed inside the case of the resonant chamber.

* * * * *